US007582045B1

(12) United States Patent
Lombardi et al.

(10) Patent No.: US 7,582,045 B1
(45) Date of Patent: Sep. 1, 2009

(54) VARIABLE RESISTANCE AQUATIC EXERCISE APPARATUS

(76) Inventors: Joseph L. Lombardi, 1 Neil Dr., Farmingville, NY (US) 11738-2857; Justin Thompson, 1 Neil Dr., Farmingville, NY (US) 11738-2857

( * ) Notice: Subject to any disclaimer, the term of this patent is extended or adjusted under 35 U.S.C. 154(b) by 0 days.

(21) Appl. No.: 11/561,836

(22) Filed: Nov. 20, 2006

(51) Int. Cl.
*A63B 21/008* (2006.01)

(52) U.S. Cl. ..... 482/111; 482/55; 482/56; 482/57; 482/58; 482/124; 482/105; 434/255; 441/56; 441/57; 441/58

(58) Field of Classification Search ..... 482/111, 482/55, 58, 73, 108, 148, 13, 44, 47–49; 441/55–63, 64, 80, 88; D21/803, 806, 807
See application file for complete search history.

(56) References Cited

U.S. PATENT DOCUMENTS 2,810,138 A * 10/1957 Cochran ..... 441/58
3,695,608 A * 10/1972 Hanson ..... 482/13
3,765,042 A * 10/1973 Montrella ..... 441/58
3,913,907 A * 10/1975 Baker ..... 482/111
4,121,312 A * 10/1978 Penney ..... 441/57
4,311,306 A 1/1982 Solloway
4,480,829 A * 11/1984 Yacoboski ..... 482/111
4,519,783 A * 5/1985 Burke, Jr. ..... 441/117
4,521,011 A * 6/1985 Solloway ..... 482/111
4,632,387 A * 12/1986 Guzman ..... 482/111
4,746,313 A * 5/1988 Bray et al. ..... 441/57
4,832,643 A * 5/1989 Schoofs ..... 441/56
4,913,418 A * 4/1990 Schlueter et al. ..... 482/55
4,932,911 A * 6/1990 Albrecht ..... 441/56
5,102,120 A * 4/1992 Lindblad ..... 482/111
5,147,233 A * 9/1992 Hannula ..... 441/56
5,167,596 A * 12/1992 Ferber ..... 482/46
5,184,993 A * 2/1993 Dowdeswell ..... 482/106
5,219,317 A * 6/1993 Beasley ..... 482/111
5,288,254 A * 2/1994 Elson ..... 441/56
5,304,080 A * 4/1994 Dilger ..... 441/58
5,385,521 A 1/1995 Weissbuch
D363,754 S * 10/1995 Johnson ..... D21/807
5,516,319 A * 5/1996 Nessel ..... 441/56
5,647,783 A * 7/1997 Nessel ..... 441/58
5,651,710 A * 7/1997 Rives et al. ..... 441/58
5,658,224 A * 8/1997 Betrock ..... 482/55
D397,187 S * 8/1998 Reeder ..... D21/807
5,842,896 A * 12/1998 Liveoak ..... 441/56
D405,146 S * 2/1999 Picciolo ..... D21/806
5,975,973 A * 11/1999 Fleming ..... 441/64
6,019,650 A * 2/2000 Rives et al. ..... 441/58
6,227,925 B1 * 5/2001 Boddy ..... 441/129
6,315,700 B1 * 11/2001 Shifferaw ..... 482/111
6,325,727 B1 * 12/2001 Carr ..... 473/228
6,379,203 B1 * 4/2002 Kuo ..... 441/64
6,540,647 B2 * 4/2003 Spooner et al. ..... 482/55
D484,559 S * 12/2003 Peek et al. ..... D21/807

(Continued)

*Primary Examiner*—Loan H Thanh
*Assistant Examiner*—Robert F Long

(57) ABSTRACT

A variable resistance aquatic exercise apparatus which provides a platform for removable fit to each of a user's hands and arms is disclosed. Each platform provides a plurality of one-way valves of two sizes. Each platform further provides a dialable disc which varies with orifice size, from a larger orifice to smaller orifices, or a user may choose to close orifices, thereby providing varied resistance to movement through water. Multiple embodiments of the platform are provided.

1 Claim, 8 Drawing Sheets

U.S. PATENT DOCUMENTS 6,685,521 B1 * 2/2004 Melius ..... 441/56
6,743,023 B2 * 6/2004 Topolski ..... 434/255
6,887,186 B2 * 5/2005 Bambanian ..... 482/55
6,899,581 B1 * 5/2005 Nokes ..... 441/58
D510,117 S * 9/2005 Jones ..... D21/805
6,955,577 B1 * 10/2005 Hall ..... 441/74
7,044,819 B1 * 5/2006 Dulemba ..... 441/58
7,125,299 B1 * 10/2006 Ross, Jr. ..... 441/56
7,128,698 B2 * 10/2006 Shifferaw ..... 482/111
7,179,146 B2 * 2/2007 Johnson ..... 441/56
7,267,595 B1 * 9/2007 Hall ..... 441/56
7,288,051 B1 * 10/2007 Phillips ..... 482/124
2004/0116256 A1 * 6/2004 Stout et al. ..... 482/55
2004/0203301 A1 * 10/2004 Johnson ..... 441/56
2005/0026518 A1 * 2/2005 Bolster ..... 441/56
2005/0075222 A1 * 4/2005 Adley ..... 482/111
2005/0210557 A1 * 9/2005 Falconer ..... 2/16
2005/0227821 A1 * 10/2005 Powell et al. ..... 482/55
2008/0032573 A1 * 2/2008 Krikliwy et al. ..... 441/56

* cited by examiner

VARIABLE RESISTANCE AQUATIC EXERCISE APPARATUS

BACKGROUND OF THE INVENTION

The benefits of water exercise are well founded. Water exercise is also especially beneficial to those with physical limitations, offering an environment closer to weightlessness, and therefore less of a weight load on limbs. The fluid environment also offers resistance training that is superior to typical weighted resistance exercises. Water exercises further have the ability to offer resistance to almost any movement, throughout almost any motion and range of motion that can be imagined. Water offers both concentric and eccentric resistance to muscular activities.

FIELD OF THE INVENTION

The variable resistance aquatic exercise apparatus relates to aquatic exercise devices and more especially to an adjustable resistance aquatic exercise device.

DESCRIPTION OF THE PRIOR ART

Prior related art U.S. Pat. No. 4,311,306 issued to Solloway on Jan. 19, 1982 teaches an aquatic exercise assembly that can be provided in various forms. The device is cumbersome by comparison to the present apparatus and does not offer the variable resistance nor design of the present apparatus. U.S. Pat. No. 4,521,011 issued to Solloway on Jun. 4, 1985 teaches a hand engageable aquatic exercise assembly that provides finger holds for grasping. The device does not provide the variable resistance adjustments of the present apparatus. U.S. Pat. No. 5,385,521 issued to Weisbuch on Jan. 31, 1995 teaches an aquatic exercise device that can be either handheld of worn. This device and others in the prior art do not provide the advantages of the present apparatus, particularly the variable resistance adjustability.

While the above-described devices fulfill their respective and particular objects and requirements, they do not describe a variable resistance aquatic exercise apparatus that provides for the advantages of the present variable resistance aquatic exercise apparatus. In this respect, the present variable resistance aquatic exercise apparatus substantially departs from the conventional concepts and designs of the prior art. Therefore, a need exists for an improved variable resistance aquatic exercise apparatus.

SUMMARY OF THE INVENTION

The general purpose of the variable resistance aquatic exercise apparatus, described subsequently in greater detail, is to provide a variable resistance aquatic exercise apparatus which has many novel features that result in an improved variable resistance aquatic exercise apparatus which is not anticipated, rendered obvious, suggested, or even implied by prior art, either alone or in combination thereof.

To attain this, the variable resistance aquatic exercise apparatus is comprised of two platforms, one of each of which is removably worn on a user's hand and arm. The user therefore preferably wears a platform on each arm. One embodiment of the apparatus provides identical platforms. Each is comprised of at least one strap for temporarily securing the platform to a user. The straps are preferably flexible and adjustable. Each platform is preferably sized at about 20 inches long and 14 inches wide at the widest dimension. Preferably, the thickness tapers, from about 1½ inches to about ¾ inch. Size varies with different embodiments, however. Each platform provides adjustable resistance, in both forward and backward movement of the platform through water. Orifice sizes available in the disc preferably range from 1 inch, 1½ inch, 2 inches, 2½ inch, and 3 inches in diameter. Orifices are preferably equidistantly spaced about the disc. The platform orifice to which the disc orifices collaborate is preferably about 3 inches in diameter.

Various materials are used in the makeup of the apparatus. Straps are made of nylon, flexible rubberized material, and other suitable strap materials. The platforms are lightweight and preferably of foam and other such synthetic materials that are appropriate for water usage. Other elastomers and plastic-like materials are used in various other components of the apparatus.

Another embodiment of the apparatus provides platforms that are shaped for right and left hand use. Each platform is a mirror image of the opposite platform, with an indent in one edge of each platform.

Each platform further provides for other novel uses. For example, a platform can be used to carry food and drink items.

Thus has been broadly outlined the more important features of the improved variable resistance aquatic exercise apparatus so that the detailed description thereof that follows may be better understood and in order that the present contribution to the art may be better appreciated.

An object of the variable resistance aquatic exercise apparatus is to provide increased resistance to a user's movements in water.

Another object of the variable resistance aquatic exercise apparatus is to provide adjustably variable resistance to a user's movement in water.

A further object of the variable resistance aquatic exercise apparatus is to provide adjustable fit.

An added object of the variable resistance aquatic exercise apparatus is to provide resistance in both fore and aft movement in water.

And, an object of the variable resistance aquatic exercise apparatus is to provide uses other than water resistance.

These together with additional objects, features and advantages of the improved variable resistance aquatic exercise apparatus will be readily apparent to those of ordinary skill in the art upon reading the following detailed description of presently preferred, but nonetheless illustrative, embodiments of the improved variable resistance aquatic exercise apparatus when taken in conjunction with the accompanying drawings.

In this respect, before explaining the current embodiments of the improved variable resistance aquatic exercise apparatus in detail, it is to be understood that the variable resistance aquatic exercise apparatus is not limited in its application to the details of construction and arrangements of the components set forth in the following description or illustration.

Those skilled in the art will appreciate that the concept of this disclosure may be readily utilized as a basis for the design of other structures, methods, and systems for carrying out the several purposes of the improved variable resistance aquatic exercise apparatus. It is therefore important that the claims be regarded as including such equivalent constructions insofar as they do not depart from the spirit and scope of the variable resistance aquatic exercise apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 9 thereof, the principles and concepts of the variable resistance aquatic exercise apparatus generally designated by the reference number 10 will be described.

Figure 1:
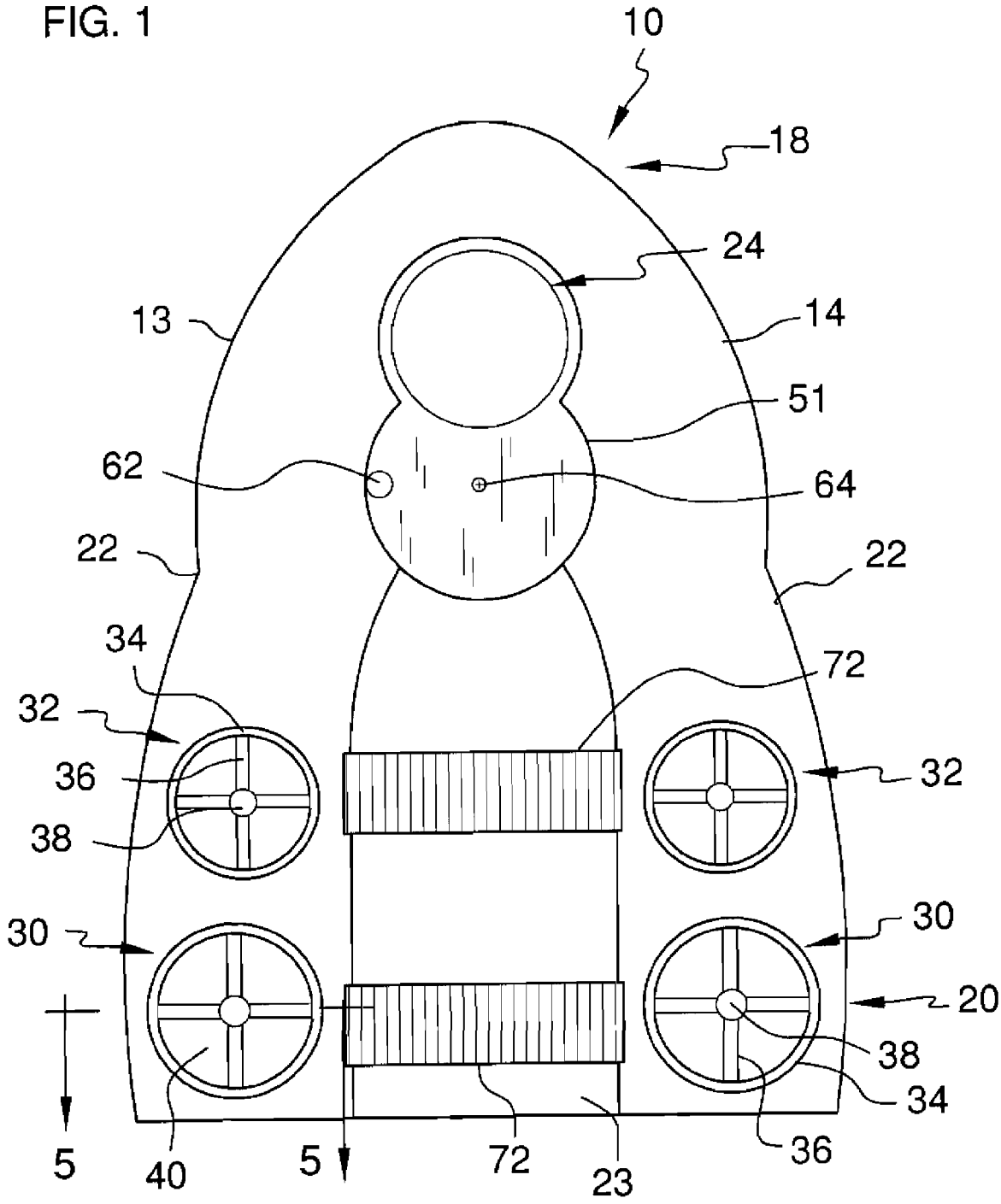
FIG. 1 is a top plan view of an embodiment of the apparatus.
Figure 2:
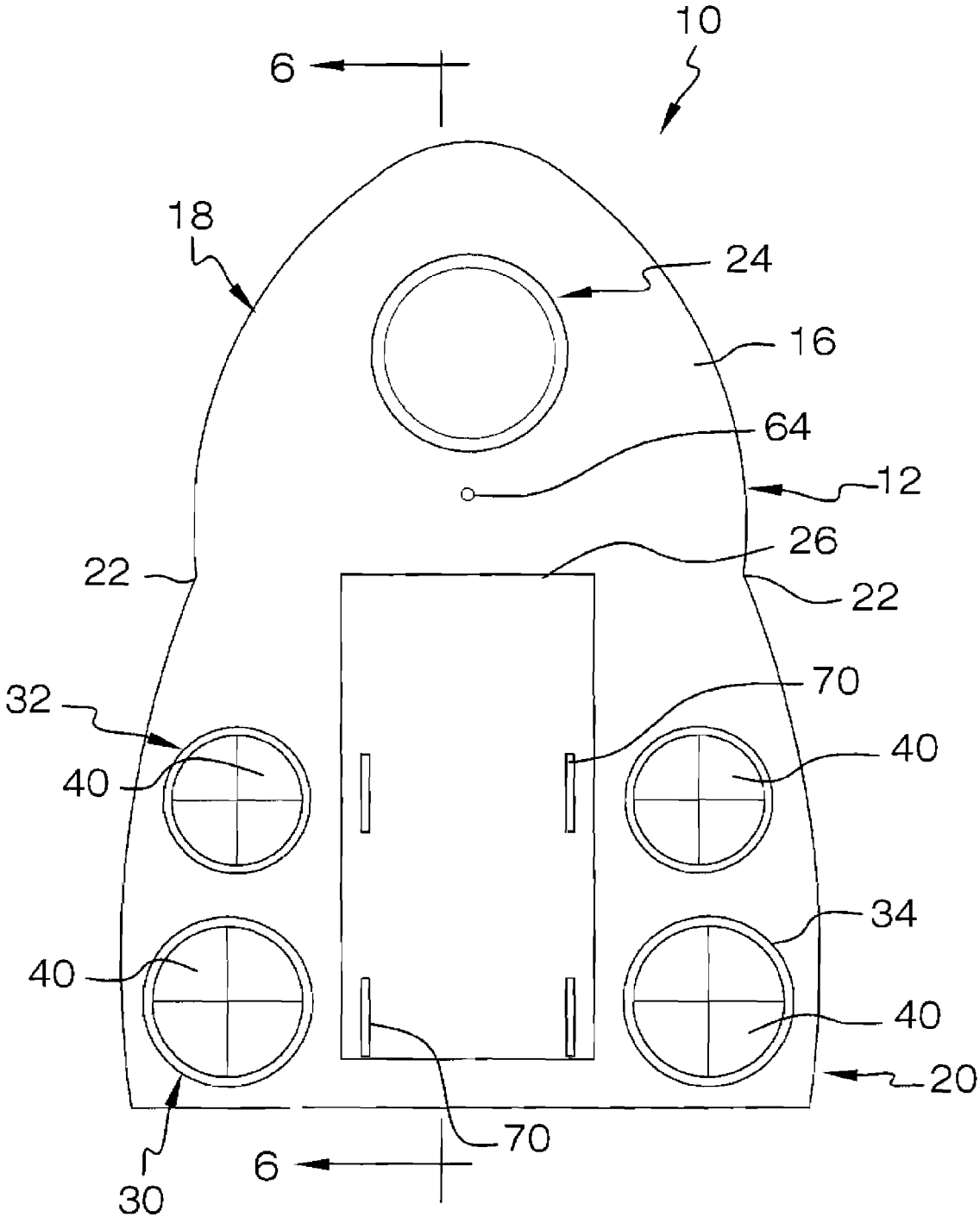
FIG. 2 is a bottom plan view of FIG. 1.

Referring to FIGS. 1 and 2, the variable resistance aquatic exercise apparatus 10 comprises a pair of platforms 12. Each platform 12 has a length, a width, and a thickness. Each platform has a heel 20, a toe 18, a top 14, and a bottom 16. Preferably, an arm depression 23 is disposed in the top 14 of each platform 12. At least one adjustable strap 72 is provided for removably securing each platform 12 to the limb of a user 200. Each strap 72 is preferably size adjustable. Each strap 72 is optionally elastic. Each strap 72 passes through strap slots 70 to anchor the strap 72 to the platform 12. More than one one-way valve 30, 32 is disposed within the platform 12. Preferably, each platform 12 comprises two small one-way valves 32 and two large one-way valves 30. The large one-way valves 30 are disposed proximal to the heel 20. The small one-way valves 32 are disposed more distally from the heel 20, above the large one-way valves 30. The one-way valves 30, 32 are disposed on either side of the arm depression 23. The platform orifice 24 is disposed proximal to the toe 18 of the platform 12.

Figure 3:
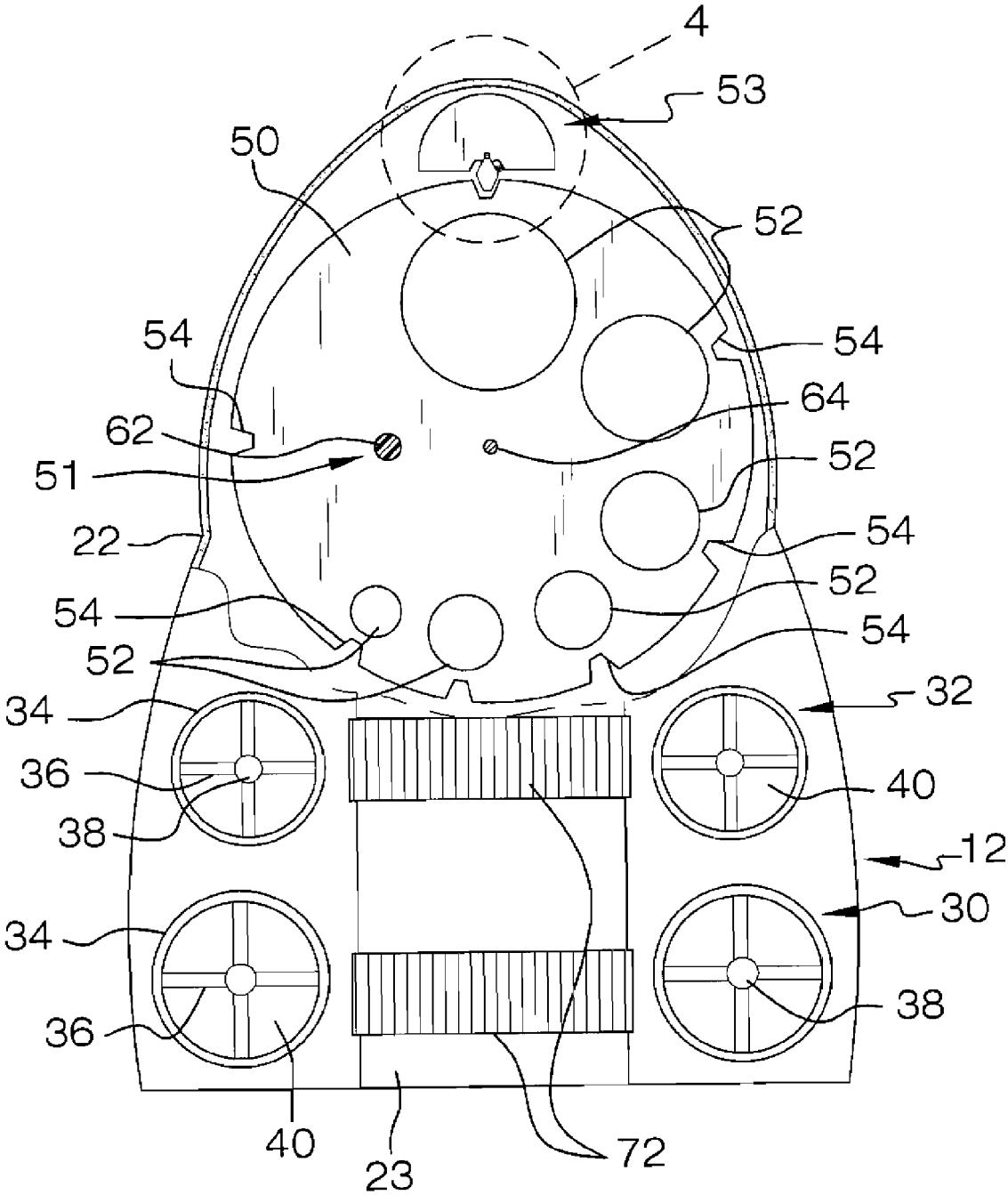
FIG. 3 is a partial cross sectional top plan view of FIG. 1.
Figure 4:
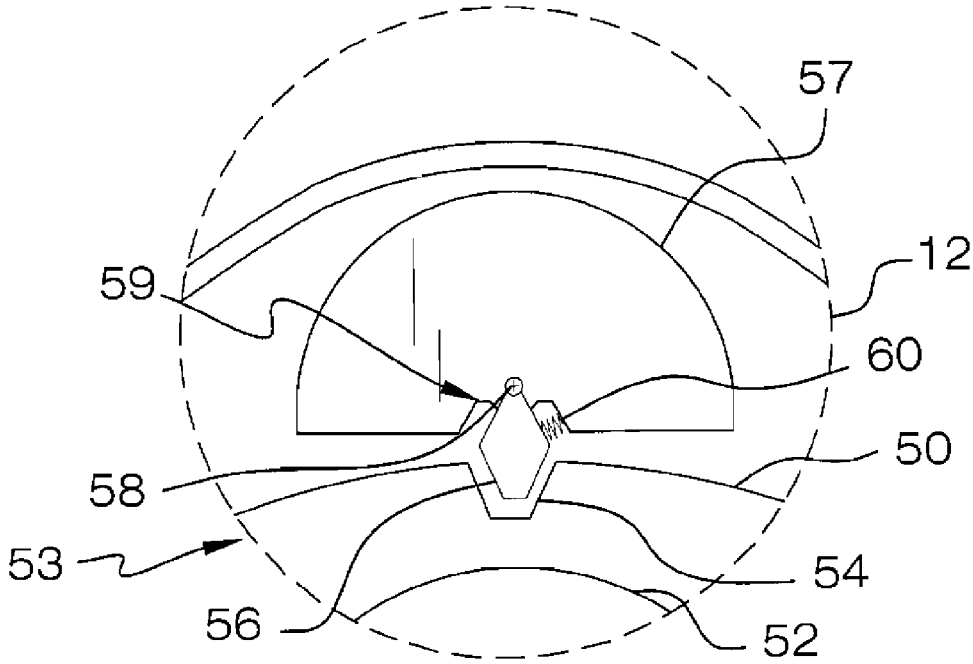
FIG. 4 is a partial blow up of FIG. 3.

Referring to FIGS. 3 and 4, the rotatable disc 50 is disposed within the platform 12 and revolves around the disc axis 64 that resides within the center section 51 of the disc 50 by using hole 62. The plurality of disc openings 52 are provided in the disc 50. Each disc opening 52 is of a different diameter.

Each opening 52 is rotatably positionable coincidentally with the platform orifice 24. The preferred means for temporarily locking each disc opening 52 in a selected position is the lock 53. The lock 53 is partially comprised of the plurality of lock notches 54 in the disc 50 and the lock tab 56. The lock tab 56 is pivotally held to the tab pivot 58. The tab pivot 58 pivots from the lower center of the tab housing 57. A pivot recess 59 is disposed on either side of the tab pivot 58, providing for limited side-to-side movement of the lock tab 56. The lock tab 56 movement is hindered in one direction and aided in the opposite direction by the spring 60, which rests against the lock tab 56 and one pivot recess 59. The spring 60 loading of the lock 53 thereby resists movement of the disc 50 in one direction and slightly aids movement of the disc 50 in the opposite direction. The lock 53 holds the disc 50 selectively in position. The disc 50 is thereby temporarily locked with one of the plurality of disc openings 52 coincidental with the platform orifice 24. The disc 50 is also capable of locking in a position of no disc opening 52 coincidental with the platform orifice 24.

Figure 5:
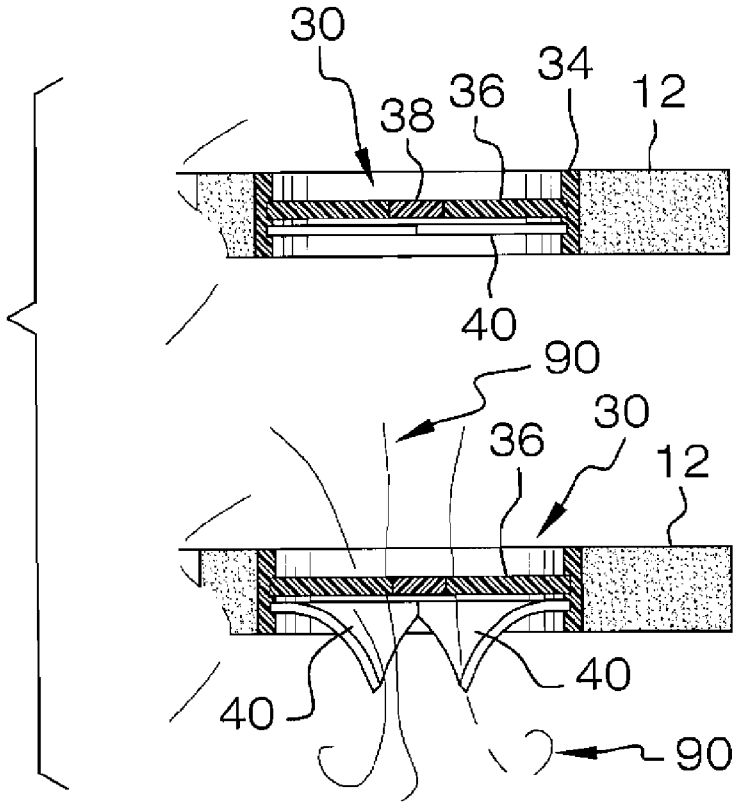
FIG. 5 is a partial cross sectional view of FIG. 1.

To FIG. 5, each small one-way valve 32 and each large one-way valve 30 is comprised of a rigid outer valve perimeter 34 surrounding a valve center 38. The plurality of valve ribs 36 extends from the perimeter 34 to the center 38. A sectioned flexible material 40 is disposed on one side of the ribs 36 and the center 38. The flex material 40 moves in one direction away from the ribs 36 to allow water flow 90, but the flex material 40 is prohibited from opposite movement via the ribs 36.

Figure 6:
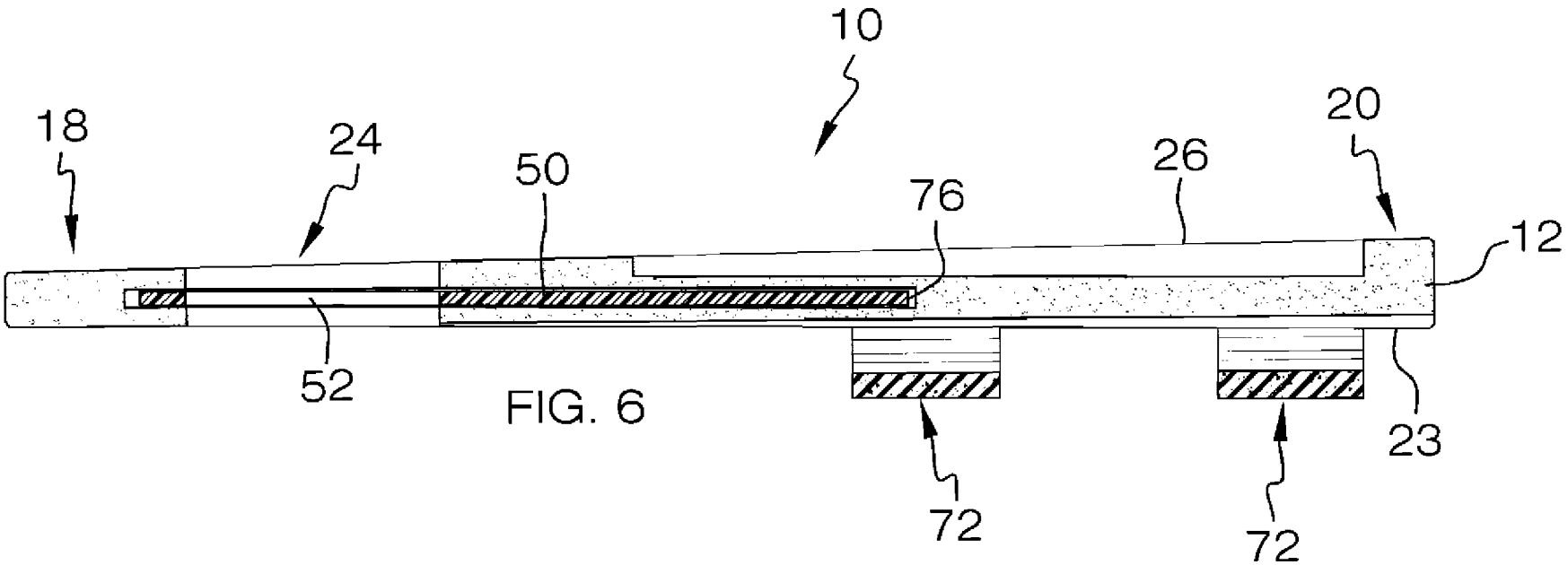
FIG. 6 is a cross sectional view of FIG. 2

Referring to FIG. 6, each platform 12 bottom 16 further comprises a cutout 26 which is similar in size and shape to the arm depression 23 on the opposite top 14 of each platform 12. The disc 50 is disposed within the platform 12 specifically within the disc cavity 76. The largest opening 52 is illustrated which in turn allows the greatest water flow 90 through the platform orifice 24. The overall thickness of the platform 12 tapers from larger at the heel 20 to the tow 18.

Figure 7:
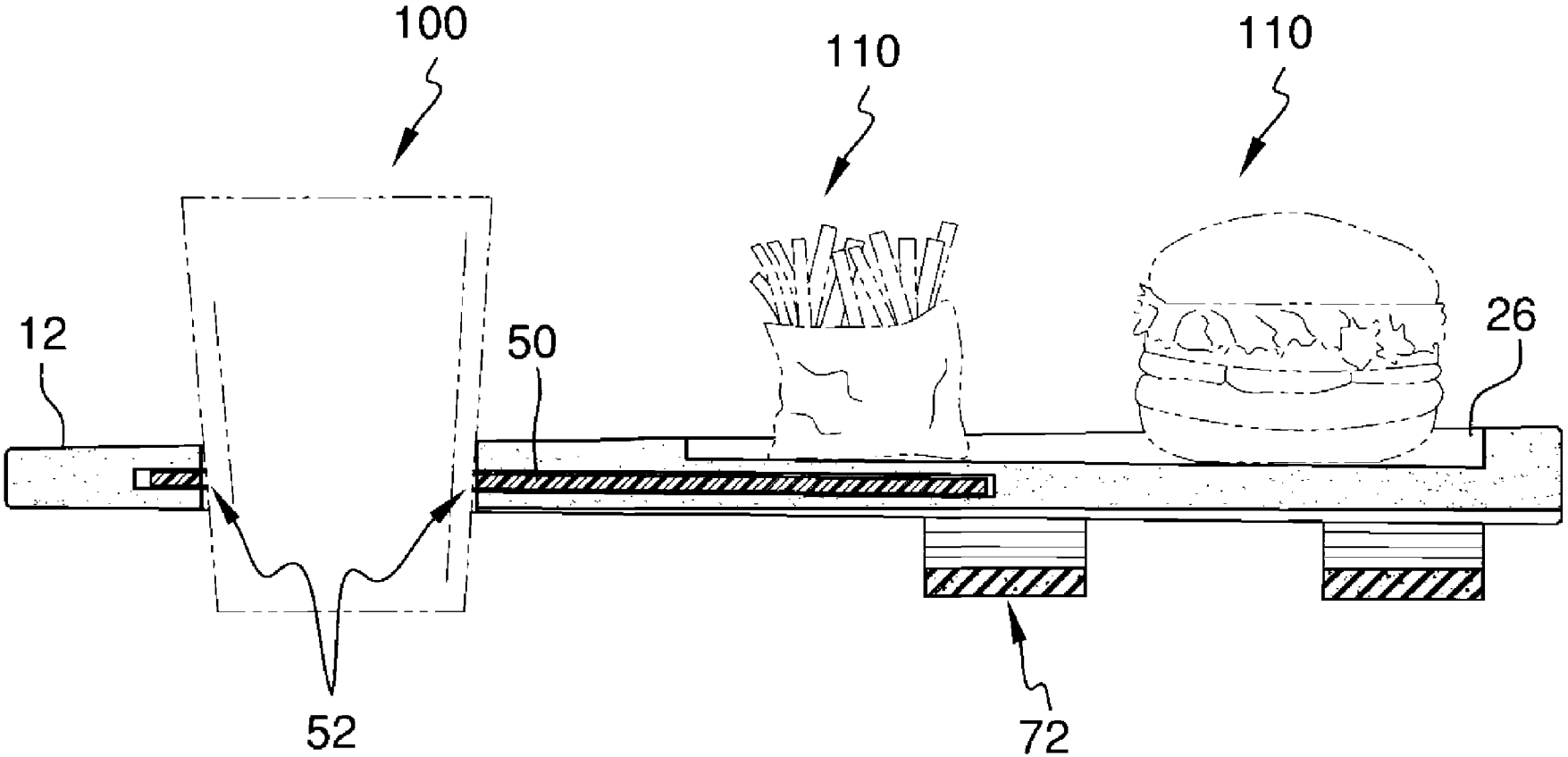
FIG. 7 is a view of FIG. 6, with alternative uses of the apparatus.

With reference to FIG. 7, the alternative use of the platforms 12 is limited only to imagination. The illustration places a drink 100 within the platform orifice 24 by way of the disc 50 being spun about the disc axis 64 to reveal the largest disc opening 52. The food items 110 are temporarily held within the cutout 26 of the bottom 16 of the platform 12.

Figure 8:
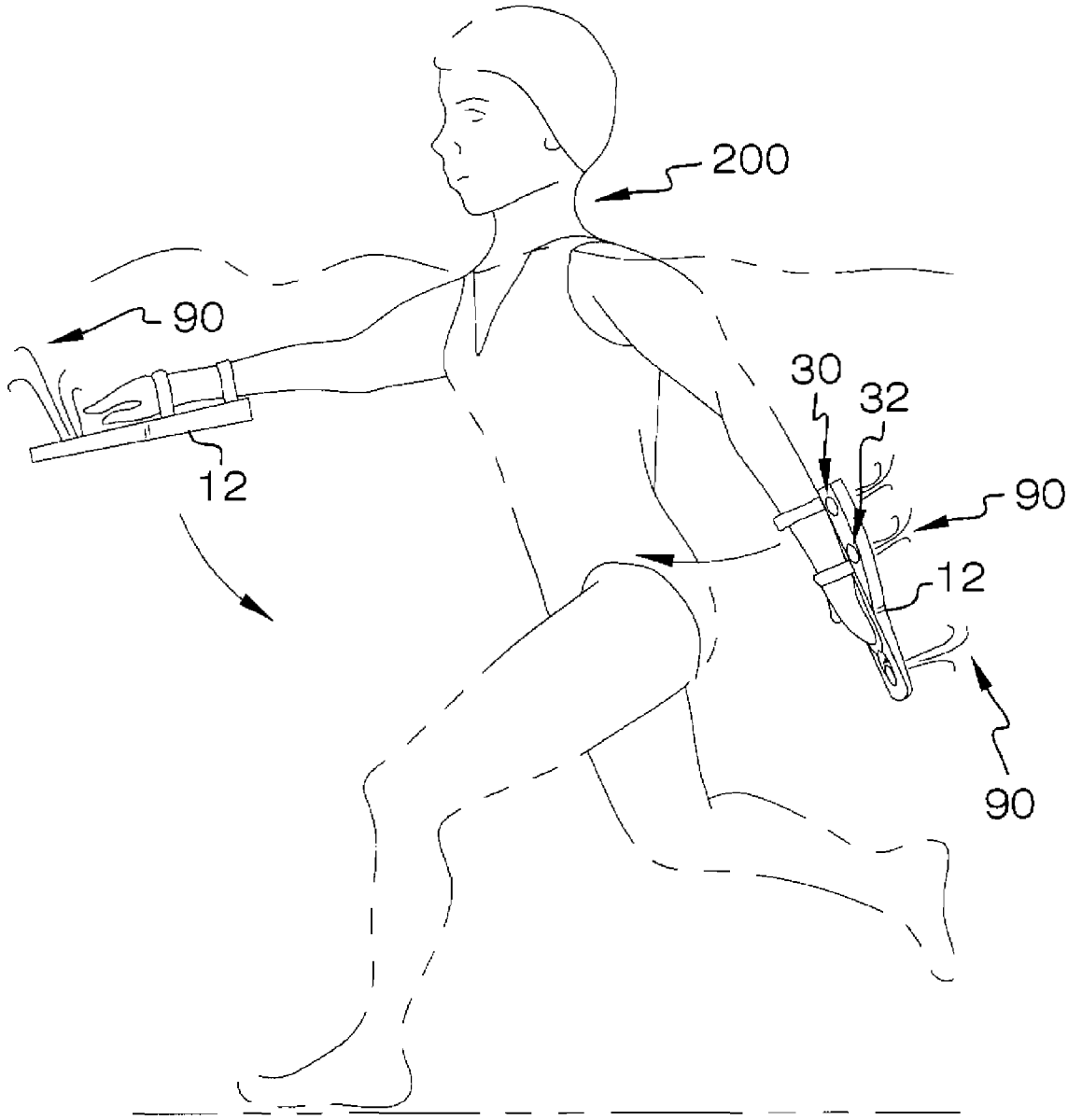
FIG. 8 is a perspective view of the apparatus in use in aquatic exercise.

Referring to FIG. 8, the user 200 is immersed in water. One platform 12 is fitted to each hand and arm of the user 200 with the toe 18 of each platform 12 farthest from the user 200. With the downward and backward motion of the user 200 right arm, the water flow 90 is illustrated passing through the platform orifice 24 and the chosen disc opening 52. The left arm of the user 200 is in forward motion as shown. The water flow 90 is reversed from that experienced by the right arm of the user 200. The water flow 90 is through the platform orifice 24 and also passes through the large one-way valves 30 and the small one-way valves 32, thereby enabling forward motion of each platform 12 to be easier than is backward motion.

Figure 9:
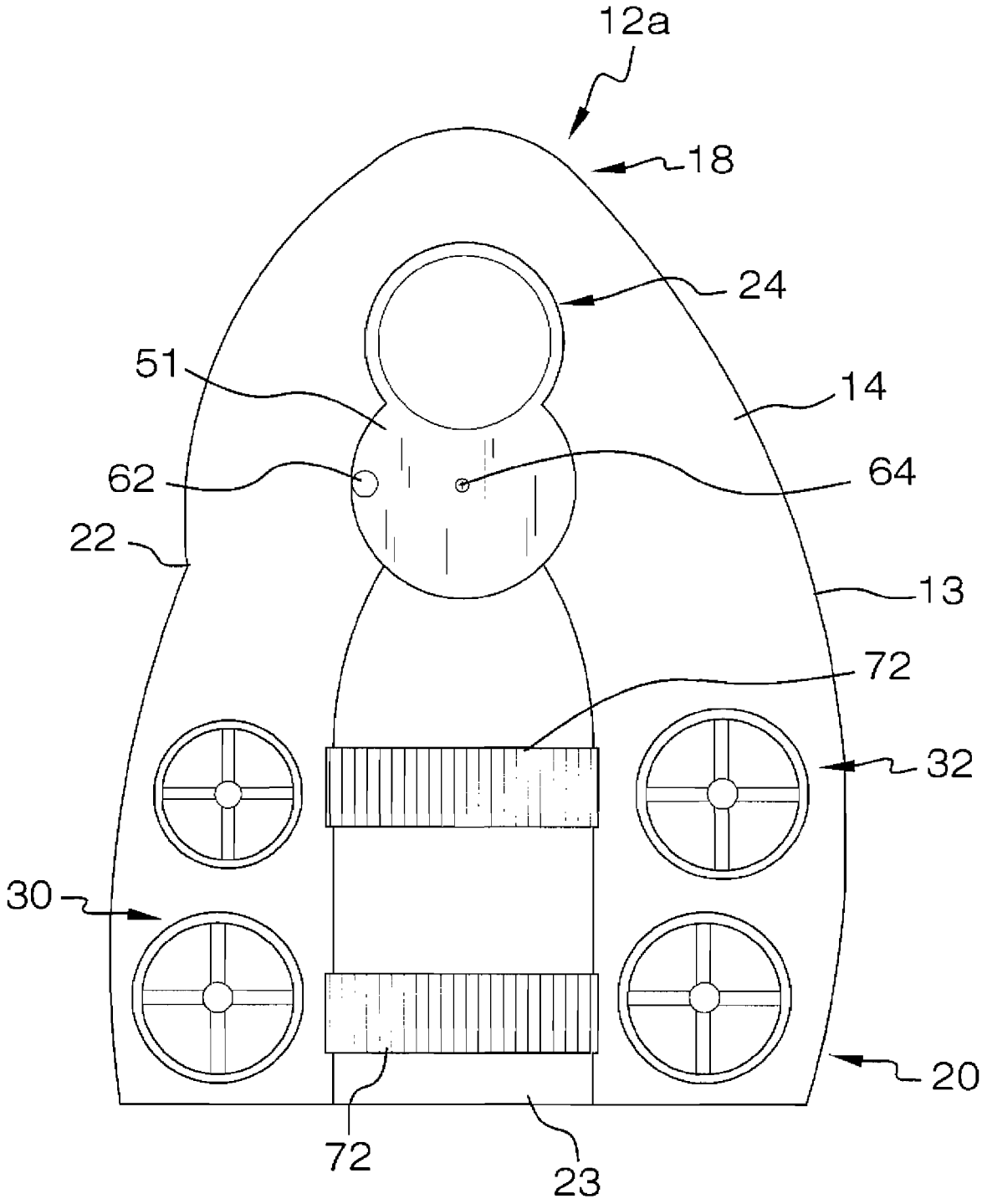
FIG. 9 is an alternative embodiment of one platform of the apparatus.

Referring to FIG. 9, an alternate embodiment of the apparatus 10 is illustrated wherein a pair of platforms 12*a* comprises one platform 12*a* that is a mirror image of the other platform 12*a*. One edge 13 of each platform 12*a* is dissimilar to an opposite edge 13 of the same platform 12*a*. One edge 13 provides an indent 22. The opposite platform 12*a* provides the indent 22 on an opposite platform 12*a* edge 13, thereby mirroring the first platform 12*a*. The platforms 12*a* are thereby provided with a right hand and a left hand embodiment.

With respect to the above description then, it is to be realized that the optimum dimensional relationships for the parts of the variable resistance aquatic exercise apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the variable resistance aquatic exercise apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the variable resistance aquatic exercise apparatus may be used.

Therefore, the foregoing is considered as illustrative only of the principles of the variable resistance aquatic exercise apparatus. Further, since numerous modifications and changes will readily occur to those skilled in the art, it is not desired to limit the variable resistance aquatic exercise apparatus to the exact construction and operation shown and described, and accordingly, all suitable modifications and equivalents may be resorted to, falling within the scope of the variable resistance aquatic exercise apparatus.

What is claimed is:

1. A variable resistance aquatic exercise apparatus, comprising:

a pair of platforms, wherein each platform comprising having a length, a width, a thickness, a heel, a toe, a top, and a bottom;

an arm depression in the top of each platform;

at least one adjustable strap for removably securing the platform to a limb of a user, each strap size adjustable;

at least two round one-way valves within the platform, wherein each one-way valve comprises:

a valve perimeter;

a valve center;

a plurality of ribs extended from the perimeter to the center;

a sectioned flexible material on a one side of the ribs and center;

wherein the plurality of one-way valves are of varied diameter;

a platform orifice;

a rotatable disc disposed within the platform;

a plurality of round disc openings through the disc, each opening of a different diameter, each opening rotatably positionable coincidentally with the platform orifice;

a plurality of notches located along the outer perimeter of the rotatable disc, wherein the notches selectively secure the rotatable disc;

a lock tab pivotably secured to the platform, the lock tab selectively engaging one of the notches;

means for temporarily locking each disc opening in a selected position;

a lock, wherein the lock secures the disc in a position of no disc opening coincidental with the platform orifice;

wherein the bottom of each platform comprises a cutout.

* * * * *